US006802584B2

(12) United States Patent
Kageyama

(10) Patent No.: US 6,802,584 B2
(45) Date of Patent: Oct. 12, 2004

(54) INK JET RECORDING APPARATUS AND INK JET RECORDING METHOD

(75) Inventor: Tetsuto Kageyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 78 days.

(21) Appl. No.: 10/073,109

(22) Filed: Feb. 12, 2002

(65) Prior Publication Data

US 2002/0118249 A1 Aug. 29, 2002

(30) Foreign Application Priority Data

Feb. 15, 2001 (JP) ..... 2001/038474
Jan. 28, 2002 (JP) ..... 2002/018528

(51) Int. Cl.[7] ..... B41J 2/07
(52) U.S. Cl. ..... 347/14; 347/9
(58) Field of Search ..... 347/5, 9, 14, 17, 347/6

(56) References Cited

U.S. PATENT DOCUMENTS 4,544,931 A * 10/1985 Watanabe et al.

OTHER PUBLICATIONS

U.S. patent application Publication No. 2002/0109742, published Aug. 15, 2002.

* cited by examiner

*Primary Examiner*—Huan Tran
(74) *Attorney, Agent, or Firm*—Fitzpatrick, Cella, Harper & Scinto

(57) ABSTRACT

An ink jet recording apparatus is constructed: a recording head for discharging ink from a plurality of discharge ports and recording onto a recording medium; a carriage on which the recording head is mounted and which reciprocatively scans on the recording medium; a recording medium conveying unit for conveying the recording medium in the direction perpendicular to a scanning direction of the carriage by a predetermined distance each time the carriage reciprocatively scans on the recording medium; an ink tank mounted at a position where it does not exercise an influence on the reciprocative scan of the carriage and the conveyance of the recording medium by the recording medium conveying unit; an ink supply tube for supplying the ink from the ink tank to the recording head; and a control section for controlling an ink discharge state of the recording head on the basis of an image signal which is inputted from an upper apparatus. An ink jet recording method in a recording control method for the recording apparatus is also provided.

6 Claims, 4 Drawing Sheets

INK JET RECORDING APPARATUS AND INK JET RECORDING METHOD

BACKGROUND OF THE INVENTION

1. Field of the Invention

The invention relates to an ink supplying device for supplying ink to a recording head which is used for an ink jet recording apparatus and relates to the ink jet recording apparatus having such an ink supplying device. More particularly, the invention relates to an ink jet recording apparatus having a tube for supplying ink from an ink tank to a recording head and relates to an ink jet recording method.

2. Related Background Art

Hitherto, in an ink jet recording apparatus for printing by reciprocating a recording head mounted on a carriage, it is necessary to increase a capacity of an ink tank in order to reduce an exchange frequency of the ink tank. However, according to a simple recording head integrated type, since inertia of the ink tank or the like mounted on the carriage increases, the ink tank is arranged at a position where it is not moved, a tube or the like is connected to the recording head on the carriage, and ink is supplied by using various pumps or the like. In the supply tube, in order to avoid a situation such that a pressure loss is increased in dependence on a bore of the tube, a viscosity, a density, and a flow velocity of the ink which flows, an ink supply amount lacks, and printing operation cannot be continued, it is necessary to set the bore to a larger value in order to decrease the pressure loss even at the time of the presumed maximum flow rate.

However, according to the conventional method of setting the tube bore at which the sufficient ink of the maximum supply amount can be supplied, the maximum ink pass amount of the supply tube increases remarkably in association with realization of a high printing speed of a printer and an increase in number of simultaneous discharge nozzles. Since the supply tube becomes thick, rigidity of the tube is high, malleability deteriorates, and it is necessary to increase a bending radius of the tube upon arrangement. It is difficult to miniaturize the apparatus. In an ink jet printer of the type such that the carriage is scanned and printing is performed, a fluctuation of the ink due to the carriage scan increases by an increase in amount of ink existing in the movable tube, and there is a problem such that a print variation is caused by a pressure fluctuation due to ink inertia.

SUMMARY OF THE INVENTION

The invention is made to solve the above problems and it is an object of the invention to provide an ink jet recording apparatus and its recording control method, in which the occurrence of a recording variation due to an increase in negative pressure in a supply tube can be prevented without increasing a bore of the supply tube.

The inventors of the present invention paid attention to the fact that in most of actual recording matters, print duties are low and the maximum ink flow rate is not always necessary. The minimum supply tube bore is set in accordance with an ink flow rate in which a use frequency of the print duty is high, and an amount of ink which flows is calculated every scan of target recording data. At the same time, the inventors found out the fact that if it is determined that the pressure loss is high and defective printing due to the lack of ink supply amount is caused on the basis of the ink viscosity calculated from ink temperature detecting means, by extending a discharge interval according to it, the ink supply amount is compensated, so that a constructing flow path such as a supply tube or the like can be miniaturized.

That is, according to the present invention, the above object is accomplished by an ink jet recording apparatus comprising: a recording head for discharging ink from a plurality of discharge ports and recording onto a recording medium; a carriage on which the recording head is mounted and which reciprocatively scans on the recording medium; recording medium conveying means for conveying the recording medium in the direction perpendicular to a scanning direction of the carriage by a predetermined distance each time the carriage reciprocatively scans on the recording medium; an ink tank mounted at a position where it does not exercise an influence on the reciprocative scan of the carriage and the conveyance of the recording medium by the recording medium conveying means; an ink supply tube for supplying the ink from the ink tank to the recording head; and control means for controlling an ink discharge state of the recording head on the basis of an image signal which is inputted from an upper apparatus, wherein the control means adjusts a scanning speed of the carriage so as to suppress an increase in negative pressure in the supply tube.

According to the ink jet recording apparatus of the invention, since the control means for controlling the scanning speed of the carriage so as to suppress the increase in negative pressure in the supply tube is provided, when the negative pressure in the supply tube rises, the scanning speed of the carriage is decreased and the amount of ink which is discharged from the recording head can be suppressed. Therefore, the occurrence of the recording variation due to the increase in negative pressure in the supply tube can be prevented without increasing the bore of the supply tube.

According to another aspect of the present invention, there is provided an ink jet recording apparatus comprising: a recording head for discharging ink from a plurality of discharge ports and recording onto a recording medium; a carriage on which the recording head is mounted and which reciprocatively scans on the recording medium; recording medium conveying means for conveying the recording medium in the direction perpendicular to a scanning direction of the carriage by a predetermined distance each time the carriage reciprocatively scans on the recording medium; an ink tank mounted at a position where it does not exercise an influence on the reciprocative scan of the carriage and the conveyance of the recording medium by the recording medium conveying means; an ink supply tube for supplying the ink from the ink tank to the recording head; and control means for controlling an ink discharge state of the recording head on the basis of an image signal which is inputted from an upper apparatus, wherein the control means adjusts a non-recording time as a time during which no ink is discharged from the recording head so as to recover a pressure in the supply tube.

According to further another aspect of the present invention, there is provided an ink jet recording apparatus comprising: a recording head for discharging ink from a plurality of discharge ports and recording onto a recording medium; a carriage on which the recording head is mounted and which reciprocatively scans on the recording medium; recording medium conveying means for conveying the recording medium in the direction perpendicular to a scanning direction of the carriage by a predetermined distance each time the carriage reciprocatively scans on the recording medium; an ink tank mounted at a position where it does not exercise an influence on the reciprocative scan of the carriage and the conveyance of the recording medium by the recording medium conveying means; an ink supply tube for supplying the ink from the ink tank to the recording head; and control means for controlling an ink discharge state of the recording head on the basis of an image signal which is inputted from an upper apparatus, wherein the control means adjusts the number of overlap recording scanning times of the carriage so as to recover a pressure in the supply tube.

According to the present invention, there is provided an ink jet recording method in a recording control method for an ink jet recording apparatus comprising: a recording head for discharging ink from a plurality of discharge ports and recording onto a recording medium; a carriage on which the recording head is mounted and which reciprocatively scans on the recording medium; recording medium conveying means for conveying the recording medium in the direction perpendicular to a scanning direction of the carriage by a predetermined distance each time the carriage reciprocatively scans on the recording medium; an ink tank mounted at a position where it does not exercise an influence on the reciprocative scan of the carriage and the conveyance of the recording medium by the recording medium conveying means; an ink supply tube for supplying the ink from the ink tank to the recording head; and control means for controlling an ink discharge state of the recording head on the basis of an image signal which is inputted from an upper apparatus, wherein the method has a step of reducing a scanning speed of the carriage when the number of dots (to be discharged) of the ink which is discharged from the recording head per unit time, in which such a number has been calculated from the image signal, is equal to or larger than a reference discharge number.

According to another aspect of the present invention, there is provided an ink jet recording method in a recording control method for an ink jet recording apparatus comprising: a recording head for discharging ink from a plurality of discharge ports and recording onto a recording medium; a carriage on which the recording head is mounted and which reciprocatively scans on the recording medium; recording medium conveying means for conveying the recording medium in the direction perpendicular to a scanning direction of the carriage by a predetermined distance each time the carriage reciprocatively scans on the recording medium; an ink tank mounted at a position where it does not exercise an influence on the reciprocative scan of the carriage and the conveyance of the recording medium by the recording medium conveying means; an ink supply tube for supplying the ink from the ink tank to the recording head; and control means for controlling an ink discharge state of the recording head on the basis of an image signal which is inputted from an upper apparatus, wherein the method has a step of extending a non-recording time as a time during which no ink is discharged from the recording head when the number of dots (to be discharged) of the ink which is discharged from the recording head per unit time, in which such a number has been calculated from the image signal, is equal to or larger than a reference discharge number.

According to still another aspect of the present invention, there is provided an ink jet recording method in a recording control method for an ink jet recording apparatus comprising: a recording head for discharging ink from a plurality of discharge ports and recording onto a recording medium; a carriage on which the recording head is mounted and which reciprocatively scans on the recording medium; recording medium conveying means for conveying the recording medium in the direction perpendicular to a scanning direction of the carriage by a predetermined distance each time the carriage reciprocatively scans on the recording medium; an ink tank mounted at a position where it does not exercise an influence on the reciprocative scan of the carriage and the conveyance of the recording medium by the recording medium conveying means; an ink supply tube for supplying the ink from the ink tank to the recording head; and control means for controlling an ink discharge state of the recording head on the basis of an image signal which is inputted from an upper apparatus, wherein the method has a step of increasing the number of overlap recording scanning times of the carriage when the number of dots (to be discharged) of the ink which is discharged from the recording head per unit time, in which such a number has been calculated from the image signal, is equal to or larger than a reference discharge number.

DETAILED DESCRIPTION OF THE PREFERRED EMBODIMENTS

Embodiments of the invention will be described hereinbelow with reference to the drawings.

(First Embodiment)

Figure 1:
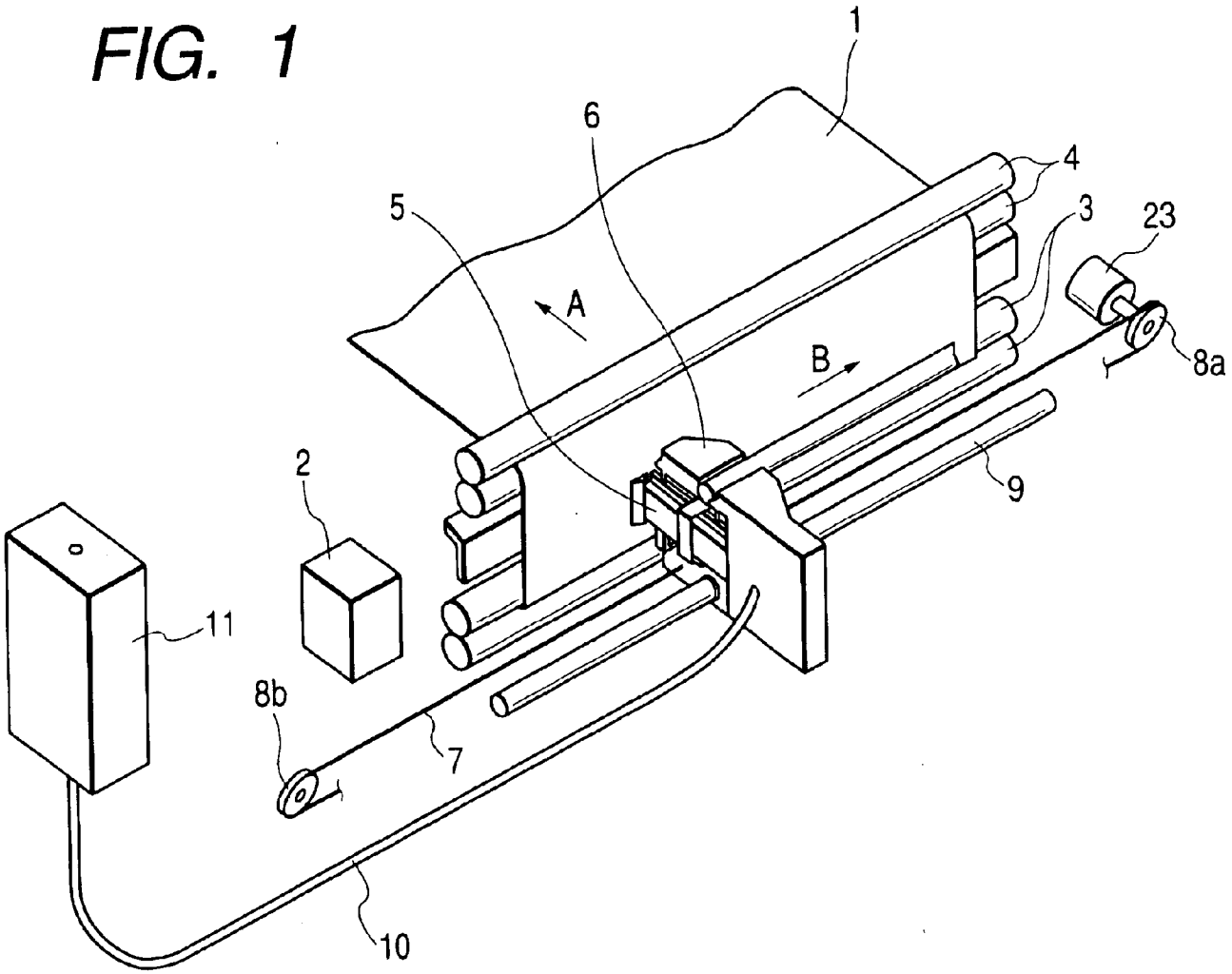
FIG. 1 is a schematic perspective view showing an example of an ink jet recording apparatus to which the invention can be applied.

A whole construction of a recording apparatus will be first described. In FIG. 1, reference numeral 1 denotes a recording medium such as a paper or the like (hereinafter, referred to as a recording sheet). As a recording sheet 1, it is wound in a roll shape or a plurality of recording sheets are stacked onto a sheet cassette. The conveyed sheet 1 is supplied to a recording position by a sheet supply roller (not shown in FIG. 1). The sheet 1 is further conveyed in the direction shown by an arrow A by a first pair of conveying rollers 3 and a second pair of conveying rollers 4 which are arranged at positions away from each other with a predetermined interval and driven by stepping motors (not shown), respectively. Reference numeral 5 denotes an ink jet recording head for recording onto the recording sheet 1. The ink is supplied to the recording head 5 via a tube 10 or the like from an ink tank 11 arranged at a position where it is not scanned. The ink is subsequently discharged from each discharge port in accordance with an image signal. The recording head 5 is mounted onto a carriage 6. A carriage motor 23 is coupled with the carriage 6 via a belt 7 and pulleys 8*a* and 8*b*. Therefore, by the driving of the carriage motor 23, the carriage 6 reciprocatively scans along a guide shaft 9.

Under the foregoing construction, the recording head 5 discharges the ink onto the recording sheet 1 in accordance with an image signal while moving in the direction shown by an arrow B, thereby recording an image. As necessary, the recording head 5 is returned to a home position and eliminates clogging or the like of the discharge ports by recovery means 2, thereby improving a discharge state. At the same time, the conveying roller pairs 3 and 4 drive and convey the recording sheet 1 in the direction of the arrow A by a distance corresponding to one line. By repeating the above operations, a desired image is recorded onto the recording sheet 1. The recovery means 2 comprises: a cap which can be joined onto a discharge port forming surface of the recording head 5; a pump which is communicated with the cap and allows a suction force to act on the discharge port forming surface; and the like.

A control system for driving each unit of the foregoing recording apparatus will now be described.

Figure 2:
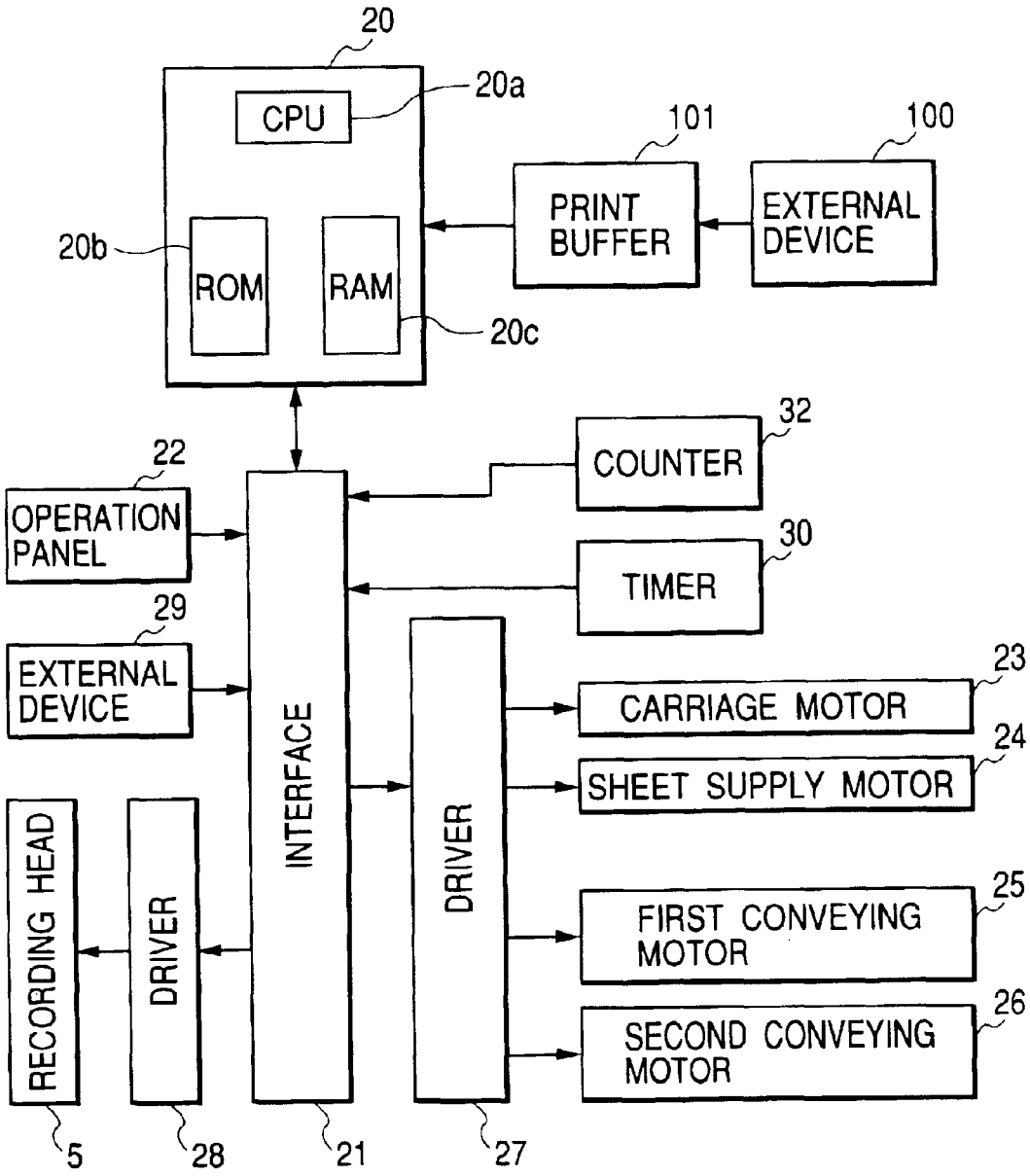
FIG. 2 is a block diagram showing a constructional example of a control system of the ink jet recording apparatus according to an embodiment of the invention.

FIG. 2 shows a constructional example of such a control system. For example, the control system comprises: a control section 20 having a CPU 20*a* such as a microprocessor or the like, an ROM 20*b* in which a control program for the CPU 20*a* and various data have been stored, an RAM 20*c* which is used as a work area of the CPU 20*a* and performs a temporary storage or the like of the various data, and the like; an interface 21; an operation panel 22; motors (the motor 23 for driving the carriage, a motor 24 for driving a sheet supply motor, a motor 25 for driving the first pair of conveying rollers, a motor 26 for driving the second pair of conveying rollers); a driver 27 for driving each of the motors; and a driver 28 for driving the recording head.

The control section 20 inputs various information (for example, a character pitch, a character type, and the like) from the operation panel 22 via the interface 21 and inputs an image signal from an external device 29. The control section 20 outputs an ON/OFF signal for driving the motors 23 to 26 and the image signal via the interface 21, thereby driving each unit by the image signal.

Information indicative of the number of discharging times at which the ink is discharged from each discharge port per unit time, that is, the information of the discharge number counted by a timer 30 and a counter 32 is transferred to the control section 20 via the interface 21.

In the above construction, the ink flow velocity in the ink flow path such as tube, joint portion, or the like changes due to the number of discharging times at which the ink is discharged per unit time. An ink temperature falls due to an influence by an air temperature or the like, the ink viscosity rises, so that the pressure loss changes. When the negative pressure in the recording head increases, a defective discharge occurs. Therefore, in the embodiment, a control is performed lest the pressure in the recording head is equal to a set negative pressure or more. Such a construction for performing the control lest the pressure in the recording head is equal to a set negative pressure or more will be described hereinbelow.

In an ink jet recording apparatus which has a head with 1280 discharge ports, discharges the ink of 4.5 pl per dot at a recording speed of 30,000 [dots/sec·discharge port], and performs the recording at a duty of the simultaneous discharge number of 50%, an ink flow rate is equal to 86.4 μl/sec. The pressure loss which is caused in the whole flow path such as tube, joint portion, or the like at this time is equal to 490 Pa (50 mmAq) or more and the pressure in the recording head approaches what is called a choking state where the ink supply cannot temporarily catch up with the ink discharging state. This results in that a change in recording density due to a change in normal discharge ink amount, that is, a recording variation occurs. In the worst case, there is a fear such that no ink is discharged and an image cannot be formed.

Now, assuming that the discharge number "N" of discharging times per unit time corresponding to the ink flow velocity in a range where the recording variation is not caused in the ink supply path in the recording apparatus is obtained, and the discharge number "N" is preliminarily stored into the ROM 20*b*. The data of the discharge number which is transferred from the counter 32 every unit time is compared with "N" and, when the discharge number per unit time exceeds "N", by controlling a recording speed so as to be reduced, that is, by controlling a discharge interval, the increase in negative pressure in the flow path is suppressed.

A method of setting the discharge number "N" per unit time will now be described.

First, a bore and a length of the tube are determined on the basis of a size of recording apparatus in consideration of the malleability. The diameter of the diameter of the tube bore is generally equal to a value within a range between about 1 mm and about 2 mm. If the viscosity and density of the ink which is used have been predetermined, the pressure loss in this system is expressed by a function of the ink flow rate per unit time. If it is expressed by the following general equation.

$$\text{Pressure loss } P=128\,\mu LQ/(\pi\rho g d^4)$$

where,

- $\mu$: viscosity ($2.5\times10^{-3}$ Pa·s at 20° C. in the general ink)
- $\rho$: density ($1.07\times10^{3}$ kg/m$^3$ in the general ink)
- g: gravitational acceleration
- $\pi$: circle ratio (cross section of the tube is generally circular)
- d: diameter of tube bore
- L: tube length
- Q: ink flow rate per unit time Therefore, when a frequency of the discharge from the nozzle is constant as mentioned above, the ink flow rate Q per unit time that is necessary for recording is determined mainly in dependence on the print duty. Thus, the value of Q can be converted into the reference discharge number N. For example, in the recording apparatus in which the diameter of the tube bore is equal to 1 mm, the tube length is equal to 1 m, the print duty is equal to 50% (the simultaneous discharge number is equal to 640 nozzles), the discharge frequency is equal to 30 kHz, and the discharge amount per dot is equal to 4.5 pl, the pressure loss P upon stationary feeding is equal to about 822 Pa (84 mmAq). The pressure loss of about 800 Pa (80 mmAq) is a safe negative pressure which does not cause a print fault in the ink jet recording. Those printing conditions are again converted from the discharge frequency and the simultaneous discharge number, thereby setting N.

When the discharge in the scan at the next time is subjected to the data exceeding N, a waiting time according to an over-number of N is set. When a predetermined amount of ink always flows, such a predetermined waiting time can be also set by a calculation. However, in the ink jet recording apparatus, upon scanning, a non-discharge time such as return time of the carriage, data transfer waiting time, or the like is also necessary. It is practically preferable to set the waiting time between the scans for each print duty on the basis of experimental values in the actual system in accordance with those requirements. In this examination, the waiting time for an over-amount of N is given to a table, thereby reducing an average flow rate. For example, if N is expressed by the print duty which can be easily handled, N is set to 50% from the above description. The waiting time is set to 0.5 sec, 1.0 sec, 1.5 sec, 2.0 sec, etc. every over-duty of 10%, and the operation is stopped for the waiting time every scan in accordance with the set waiting time, thereby waiting until the increase in negative pressure in the tube is settled.

Since the flow rate Q per unit time is a fundamental factor, the recording speed can be reduced according to the waiting time between the scans or the recording speed can be also directly reduced. However, usually, the reduction in recording speed according to the waiting time can be more easily performed. Although the waiting time has been set to an equal time interval in the embodiment, strictly speaking, it is expressed by a multidegree equation. The above setting expression is substituted for it for the purpose of simplifying the equation.

A countermeasure against the increase in negative pressure is not limited to the use of the foregoing means but the increase in negative pressure can be avoided by using, for example, the tube with a large bore in which the pressure loss is small even in case of the presumed maximum recording ink amount per unit time. However, according to this method, since the rigidity of the tube in which bending performance is required is increased, it is difficult to miniaturize the apparatus. In any cases, a ratio of a range where an image is formed by actually discharging the ink in a recording target range of a general recorded matter, that is, the print duty is equal to or less than 10% in case of a document and is equal to about 50% in case of a photograph image or the like. It is considered that the ink flow rate per unit time hardly exceeds such a duty value. Therefore, as for the increase in negative pressure in the ink supply path in the present apparatus, the apparatus can be miniaturized by a using method whereby, for example, the tube bore in which the ink can be supplied without a recording variation at the print duty of 50% is set, "N" is set to the discharge number per unit time corresponding to the ink flow rate at that time, and only when data of the print duty exceeding it is received, the foregoing control is performed.

Figure 3:
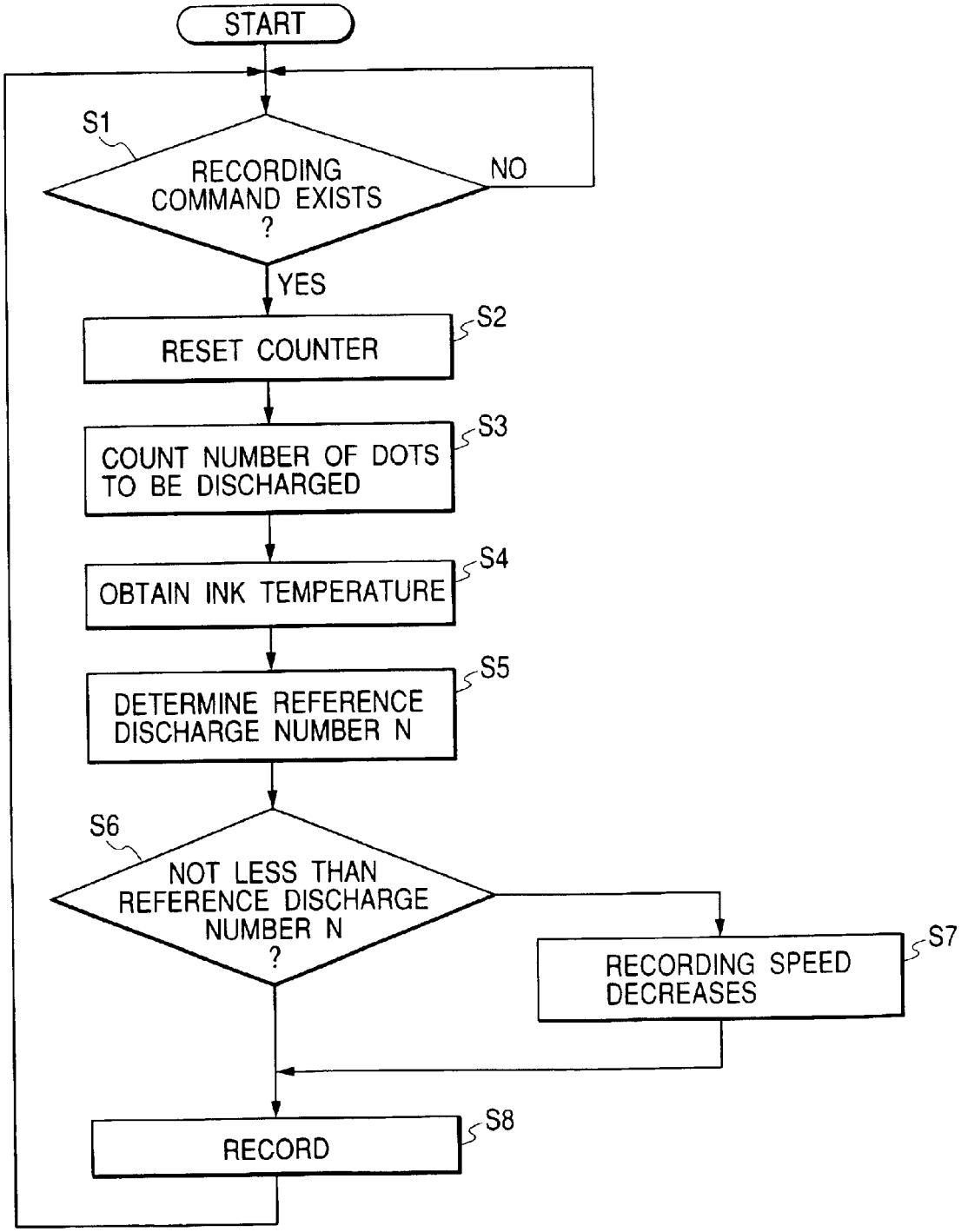
FIG. 3 is a flowchart showing an example of a recording operation control procedure of the control system of the ink jet recording apparatus according to an embodiment of the invention.

FIG. 3 shows an example of a procedure for the recording operation by the recording apparatus with the above construction.

First, in step S1, when a recording command is inputted, the counter 32 is reset (step S2) and the recording is started. At this time, the number of dots to be discharged is counted by the counter 32 (step S3). The ink temperature is obtained from a temperature sensor (step S4). The prescribed reference discharge number "N" is determined from the ink temperature (step S5). The number of dots to be discharged is compared with the reference discharge number "N" in which the increase in negative pressure is small (step S6). If the count value is equal to or less than "N", the print recording is executed (step S8). If the count value is more than "N", the recording speed is decreased to a preset speed (step S7) in order to avoid the decrease in ink discharge amount due to the increase in negative pressure and the print recording is executed (step S8). The processing routine is returned to step S1 and the apparatus waits for the next recording command.

Specifically speaking, the decrease in recording speed denotes that the discharge frequency for recording is lowered (the discharge interval is widened) and, in the apparatus of a serial printer form like an embodiment, the scanning speed of the recording head is reduced in accordance with it.

By controlling as mentioned above, since the ink is not discharged at the ink flow velocity over the speed at which the increase in negative pressure advances upon recording, the occurrence of the lack of ink supply amount in the recording head portion, that is, the recording variation, a white stripe, or the like is prevented, and high picture quality can be accomplished.

Similarly, when the ink temperature drops due to an influence by the air temperature, the ink viscosity rises. Even in case of the same flow rate, the increase amount of the negative pressure eventually increases. Therefore, by changing "N" on the basis of the ink temperature, both of the increase in negative pressure due to the ink temperature and the increase in negative pressure due to the ink flow rate per unit time can be also compensated.

(Second Embodiment)

Figure 4:
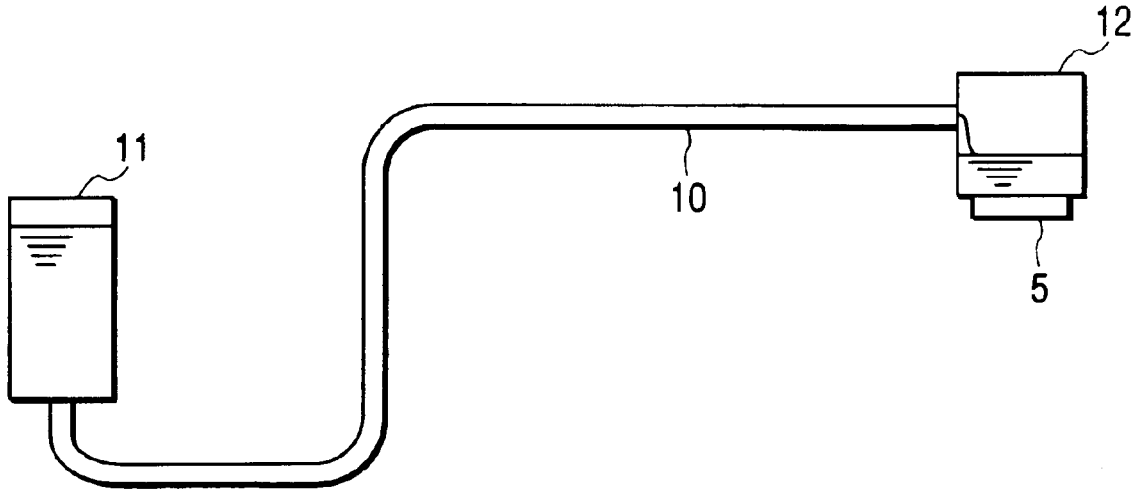
FIG. 4 is a schematic constructional diagram showing the second embodiment of the invention.

FIG. 4 is a constructional diagram of the second embodiment of an ink jet recording apparatus of the invention.

In the embodiment shown in FIG. 4, a pressure smoothing tank 12 is added to the first embodiment using the ink tank fixed to the non-scanning position, the recording head fixed onto the carriage, and the tube connecting them. In a serial printer, besides the recording time which is necessary in the actual ink discharge, a non-recording time such as a return time of the carriage in the unidirectional printing or a non-recording time such as carriage stop time, data reception developing time, or the like in the bidirectional printing exists. Upon recording onto a sheet paper, a sheet supply time per sheet of paper also becomes a non-recording time. If a capacity of the pressure smoothing tank is set to an air capacity in which, for example, even if the negative pressure increases in the recording time in one scan, it can be recovered to the original pressure within a remaining non-recording time, a time which elapses until the ink supply amount reaches the lack of supply amount can be extended. An interval for counting the number of discharge times can be extended in accordance with such an air capacity and, at the same time, even when the count value momentarily exceeds the discharge number "N", the pressure change can be buffered and control precision can be set to low precision. Instead of controlling a discharge feeling in the recording time, by setting the recording speed to be constant and extending the non-recording time, that is, the stop time or the like, the ink flow velocity per unit time can be also suppressed.

In the foregoing embodiments, although the ink flow velocity has been substituted as the discharge number of ink droplets due to the recording data, by monitoring a pressure in the pressure smoothing tank by using detecting means such as a pressure sensor or the like and feeding back a detected pressure, a more accurate control can be also performed.

As described above, according to the invention, the minimum supply tube bore is set in accordance with the ink flow rate of a high use frequency of the print duty and the amount of ink which flows is calculated every unit time of the target recording data. On the basis of the ink viscosity calculated from the ink temperature sensor, if it is determined that the pressure loss is high and the defective printing due to the lack of ink supply amount is caused, by extending the discharge interval according to it, the ink supply amount is compensated. The constructing flow path such as a supply tube or the like is miniaturized.

What is claimed is:

1. An ink jet recording apparatus comprising:

a recording head for discharging ink from a plurality of discharge ports and recording onto a recording medium;

a carriage on which said recording head is mounted and which reciprocatively scans on said recording medium;

recording medium conveying means for conveying said recording medium in the direction perpendicular to a scanning direction of said carriage by a predetermined distance each time said carriage reciprocatively scans on said recording medium;

an ink tank mounted at a position where it does not exercise an influence on the reciprocative scan of said carriage and the conveyance of said recording medium by said recording medium conveying means;

an ink supply tube for supplying the ink from said ink tank to said recording head; and control means for controlling an ink discharge state of said recording head on the basis of an image signal which is inputted from a host apparatus, wherein said control means adjusts a non-recording time as a time during which no ink is discharged from said recording head so as to recover a pressure in said supply tube; and wherein when the number of dots of ink to be discharged from said recording head per unit time, in which said number has been calculated from said image signal, is equal to or larger than a reference discharge number, said control means determines that the negative pressure in said supply tube has increased.

2. An apparatus according to claim 1, wherein when a print duty is equal to a predetermined value, said reference discharge number is equal to a discharge number in which it has previously been confirmed that no recording variation occurs.

3. An apparatus according to claim 1, wherein said reference discharge number is equal to a reference discharge number calculated on the basis of an ink flow rate and a presumed negative pressure calculated by a predetermined pressure calculating equation.

4. An apparatus according to claim 1, wherein the increase in negative pressure in said tube is detected by a pressure sensor provided in said pressure smoothing tank.

5. An ink jet recording method in a recording control method for an ink jet recording apparatus comprising:

a recording head for discharging ink from a plurality of discharge ports and recording onto a recording medium;

a carriage on which said recording head is mounted and which reciprocatively scans on said recording medium;

recording medium conveying means for conveying said recording medium in the direction perpendicular to a scanning direction of said carriage by a predetermined distance each time said carriage reciprocatively scans on said recording medium;

an ink tank mounted at a position where it does not exercise an influence on the reciprocative scan of said carriage and the conveyance of said recording medium by said recording medium conveying means;

an ink supply tube for supplying the ink from said ink tank to said recording head; and control means for controlling an ink discharge state of said recording head on the basis of an image signal which is inputted from a host apparatus, wherein said method has a step of extending a non-recording time as a time during which no ink is discharged from said recording head when a calculated number of dots of ink to be discharged from said recording head per unit time, in which said number has been calculated from said image signal, is equal to or larger than a reference discharge number.

6. A method according to claim 5, wherein said reference discharge number is equal to a reference discharge number calculated on the basis of an ink flow rate and a presumed negative pressure calculated by a predetermined pressure calculating equation.

* * * * *